United States Patent [19]

Kirk

[11] 4,344,645

[45] Aug. 17, 1982

[54] TEE-TYPE LEG BRACKET

[75] Inventor: Kenneth L. Kirk, Cranston, R.I.

[73] Assignee: Amtrol Inc., West Warwick, R.I.

[21] Appl. No.: 194,280

[22] Filed: Oct. 6, 1980

[51] Int. Cl.[3] ..... F16L 3/00

[52] U.S. Cl. ..... 285/61; 285/156; 285/423; 220/69; 248/146; 248/188; 248/188.7

[58] Field of Search ..... 220/69; 285/61, 156, 285/423; 248/146, 151, 188.7, 188

[56] References Cited

U.S. PATENT DOCUMENTS

| | | | |
|---|---|---|---|
| 817,589 | 4/1906 | Roberts . | |
| 845,760 | 3/1907 | Coffin . | |
| 999,672 | 8/1911 | Puffer . | |
| 1,511,842 | 10/1924 | Schmidt | 241/293 |
| 1,511,842 | 10/1924 | Wagner . | |
| 1,673,653 | 6/1928 | Wagner . | |
| 1,691,912 | 11/1928 | Badger . | |
| 1,717,142 | 6/1929 | Bump | 248/187.7 |
| 2,113,060 | 4/1980 | Sanberg | 113/120 |
| 2,187,917 | 1/1940 | Skinner et al. | 122/14 |
| 2,199,481 | 5/1940 | Chappell | 248/146 |
| 2,263,021 | 11/1941 | Uecker | 220/64 |
| 2,303,125 | 11/1942 | Knight | 52/788 |
| 2,303,125 | 11/1942 | Koppel | 220/70 |
| 2,503,339 | 4/1950 | Jandus | 220/10 |
| 2,542,543 | 2/1951 | Losee | 219/39 |
| 2,587,840 | 3/1952 | Gruetjen | 220/67 |
| 2,758,367 | 8/1956 | Dougherty | 29/446 |
| 2,809,267 | 10/1957 | Schauer | 219/38 |
| 2,866,742 | 12/1958 | Sutton | 204/197 |
| 3,123,054 | 3/1964 | Smith | 122/135 |
| 3,253,731 | 5/1966 | Fink et al. | 332/579 |
| 3,358,118 | 12/1967 | Mather et al. | 219/311 |
| 3,588,015 | 6/1971 | Bereday | 248/188.7 |
| 3,854,454 | 12/1974 | Lazaridis | 122/33 |
| 3,901,278 | 8/1975 | Feistel | 138/30 |

*Primary Examiner*—Dave W. Arola

*Attorney, Agent, or Firm*—Fisher, Christen & Sabol

[57] ABSTRACT

Tee-type leg bracket for supporting a tank, which has a hemispherical-type of bottom surface and a short nipple mounted on the bottom surface at substantially a right angle thereto. The bracket has a central frame, a tee vertically mounted on the central frame, and three support legs detachably attached to the central frame. The bottom surface of the tank rests on the top portion of the support legs. The contour of the top surface of the support legs matches the contour of the bottom surface of the tank. The top arm of the vertically-mounted tee mates with the short nipple mounted on the bottom of the tank. The means of attaching the support legs to the central frame involves vertical grooves in the edge region of the central frame. The mouth of each of the vertical grooves is narrower than the interior portion thereof. The number of vertical grooves is also equal in number to the support legs. There is a vertical rib on one end of each of the support legs. Each of the vertical ribs has the same horizontal cross-section as the horizontal cross-section of each of the vertical grooves in the central frame and slidably fits into one of the vertical grooves. The tee-type leg bracket has the important advantages: that it provides a unit which contains support legs which self-adjust and self-level when supporting a tank; that it allows easy installation in a piping system and is easily accessible.

19 Claims, 7 Drawing Figures

FIG. 6
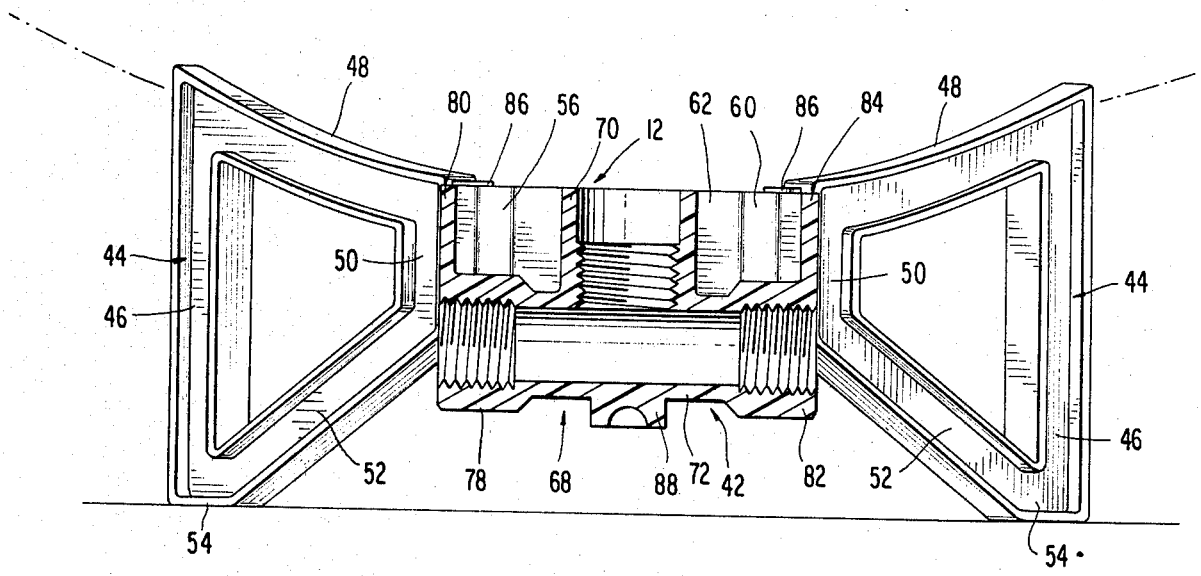
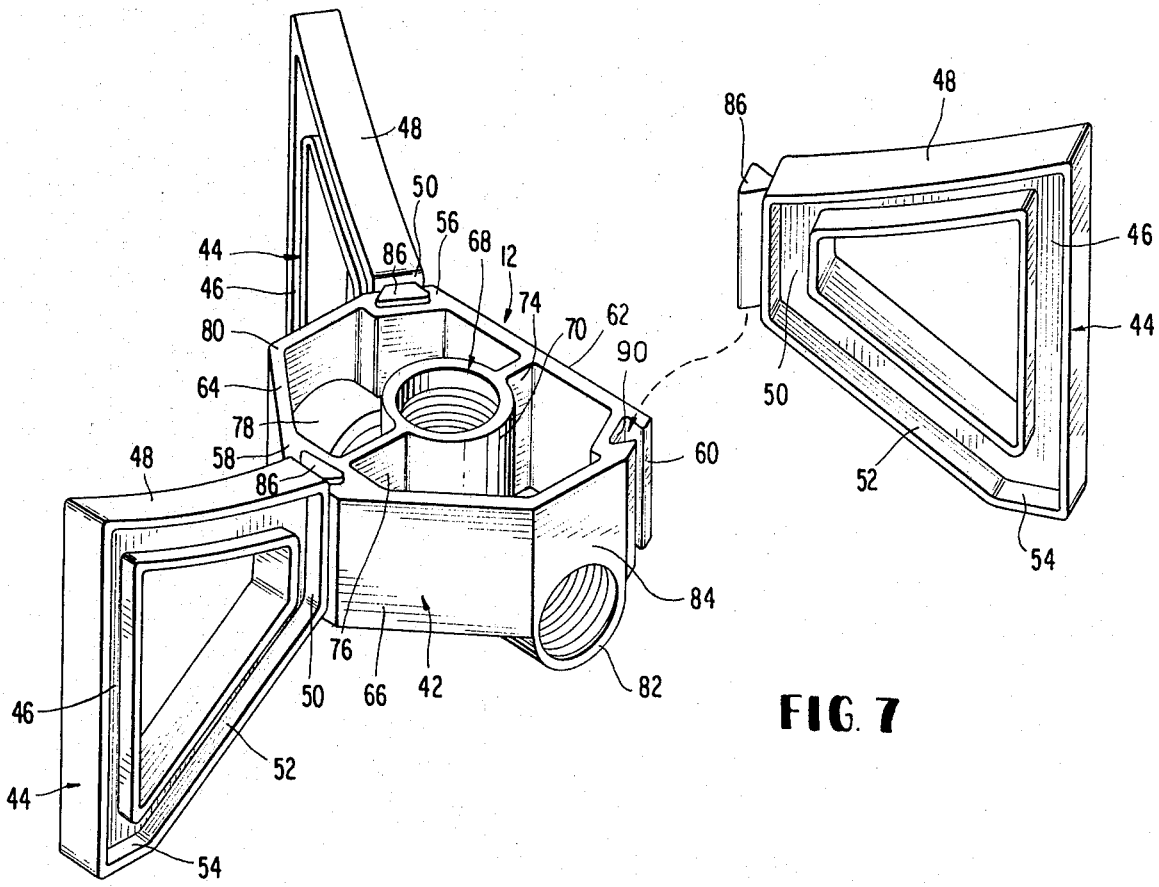
FIG. 7

TEE-TYPE LEG BRACKET

BACKGROUND OF THIS INVENTION

1. Field of This Invention

This invention relates to a support bracket for tanks.

2. Prior Art

Tanks are commonly supported in a vertical position by a stand attached to the bottom of the tank. The stand is cylindrical with both ends open. One rim of the stand is welded to the hemispherical bottom of the tank. Such support system is simple but has a number of disadvantages. To achieve access to the bottom pipe of the tank, the tank must be tilted or placed on its side or an access hole must be cut in the side of the cylindrical support (this latter approach gives little room to work in the crowded area). The tank cannot easily be removed or replaced without having to disturb the existing piping. The cylindrical support tends to cause a condensation problem on the bottom of the tank. The cylindrical support is not self leveling and has an alignment problem. The bulk of the cylindrical support means added shipping costs. Normally the cylindrical support is welded onto the bottom of the tank before shipment to the customer.

BROAD DESCRIPTION OF THIS INVENTION

An object of this invention is to provide a support bracket for a tank which avoids the above-mentioned problems of certain prior art tank supports. Other advantages and objects of this invention are set out therein or are obvious herefrom to one ordinarily skilled in the art.

The objects and advantages of this invention are achieved by the tee-type leg bracket of this invention.

This invention involves a tee-type leg bracket for supporting a tank, which has a hemispherical-type or conical-type of bottom surface and a short nipple mounted on the bottom surface at substantially a right angle thereto. The bracket has a central frame, a short pipe vertically mounted on the central frame, and at least three support legs detachably attached to the central frame. Preferably the vertically-mounted short pipe (coupling) is the upper arm of a tee pipe. The bottom surface of the tank rests on the top portion of the support legs. The vertically-mounted short pipe is usually centrally located on the central frame of the bracket which mates with the short nipple mounted on the bottom of the tank.

The tee-type leg bracket of this invention has a number of important advantages. Even when a tank is mounted on the tee-type leg bracket, it allows easy and unlimited access from any direction (in the horizontal). This also means that there is no condensation or moisture under the tank due to the excellent ventilation provided by the tee-type leg bracket. When a tank is not mounted on it, there is unlimited access from the top. The tee-type leg bracket provides a unit which contains support legs which are self-adjusting or self-leveling when supporting a tank—it therefore has no alignment problems. It provides at least three-point well-spaced floor support. The tee-type leg bracket is easily installed. The tee-type leg bracket can be installed in a piping installation with the tank being separately installed thereafter. The tank can easily be removed and replaced without having to disassemble the bracket or remove the bracket from the piping system or disassemble part of the piping system. Considerable transportation costs can be saved from the fact that the brackets can be shipped in the broken-down state (with the tanks) thereby saving shipping space. By shipping the brackets in the broken-down state, there is far less transportation damage.

When the tee-type bracket of this invention is used as a tee, it can be installed straight through for along-the-wall installations, or to simplify tank replacements, to existing piping. It can be installed from either side and the other side plugged or it can be used as the alternate connection for a relief valve without a tee. The size of the existing tank can be upgraded without repiping by simply replacing it with a larger capacity tank. A number of tee-type leg brackets can be installed in line with simple straight pipe connection between each of them without the need for complicated piping manifolds—this arrangement allows in line installation of a multiple of tanks.

Preferably the tee-type leg bracket has three support legs. Preferably the contour of the top surface of the support legs matches the contour of the bottom surface of the tank. Also, preferably the means of attaching the support legs to the central frame involves vertical grooves in the edge region of the central frame. The mouth of each of the vertical grooves is narrower than the interior portion thereof. The number of vertical grooves is also equal in number to the support legs. There is a vertical rib on one end of each of the support legs. Each of the vertical ribs has the same horizontal cross-section as the horizontal cross-section of each of the vertical grooves in the central frame and slidably fits into one of the vertical grooves. Preferably the clearance is quite close.

Preferably the short nipple mounted on the bottom of the tank is externally threaded on the end portion thereof; preferably the centrally-located short pipe mounted on the central frame of the bracket is internally threaded on the end portion and is adapted to threadingly mate and communicate with the short nipple mounted on the bottom of the tank. Also, preferably at least one short pipe communicates with the vertically-mounted short pipe on the central frame of the bracket and is horizontally mounted on the central frame of the bracket. This allows use of, for example, as a 90° elbow, as a 90° service elbow, as a tee or as a service tee. Preferably the ends of the horizontally-mounted short pipes are mounted on the end and extend through two opposing walls of the central frame of the bracket.

The bracket of this invention is self-leveling since the bracket legs are slidably mounted in vertical grooves in the edges of the central frame of the bracket. The bracket helps with the alignment of the tank. The bracket is usually non-ferrous, which means it has no corrosion problem yet has a long life. The bracket has an open construction which helps eliminate the formation of condensation on the bottom of the tank. The tank can easily be removed without having to disturb the existing piping.

The tee-type leg bracket of this invention preferably has three legs, but can have four or more leg supports.

This invention also includes the combination of the tank mounted on the tee-type leg bracket.

The bracket of this invention provides a sizable reduction in shipping costs as the bracket can be disassembled during shipping—this allows the shipment of a substantially greater number of tanks and support brackets in the same shipping space (e.g., truck trailer) with a reduction to essentially zero of damage to the tank support means (i.e., support bracket in this case) during transportation.

BRIEF DESCRIPTION OF THE DRAWINGS

The preferred embodiment of this invention is set out in the drawings. In the drawings:

FIG. 6 is a side elevational view of the tee-type leg bracket of this invention with a cross-sectional view of the central frame along line 6—6 in FIG. 4; and FIG. 7 is a partially exploded perspective view of the tee-type leg bracket of this invention.

DETAILED DESCRIPTION OF THIS INVENTION

Figure 1:
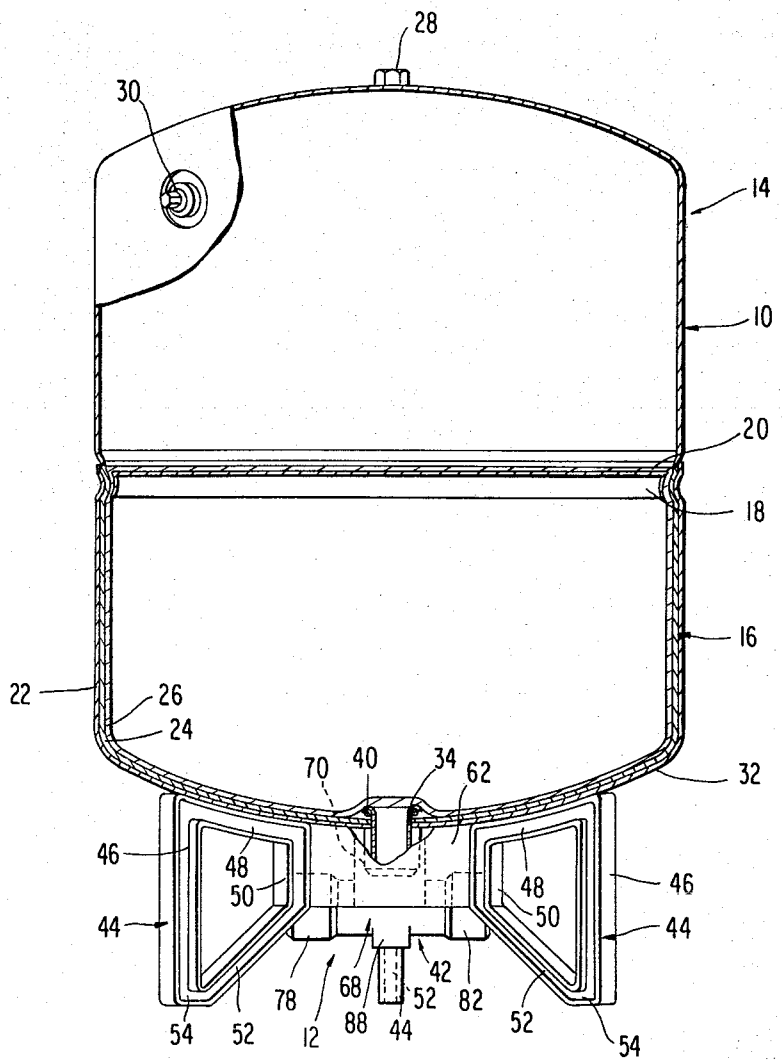
FIG. 1 is a partially cutaway side view of a tank mounted on the tee-type leg bracket of this invention.

In FIG. 1, tank 10 is supported by tee-type leg bracket 12. Tank 10 contains air dome portion 14, water dome portion 16 and inverted diaphragm 18, which separates air dome portion 14 and water dome portion 16. Air dome portion 14 and water dome portion 16 are welded together at seam 20. Water dome portion 16 is composed of three wall portions, namely, outer wall 22 and liners 24 and 26. Air dome portion 14 contains silver soldered hex nut 28 and charge valve assembly 30. Bottom surface 32 of water dome portion 16 contains vertically-mounted short pipe segment 34 in the center thereof. Short nipple 34 extends (protrudes) into water dome portion 16 and is externally threaded (male threaded) on its bottom end. As shown, liner 26 covers the upper end of short nipple 34, but a corresponding opening can be provided in liner 26. Short nipple 34 is sealed to the interior side of bottom section 32 by being lipped over sealing ring 40.

Figure 2:
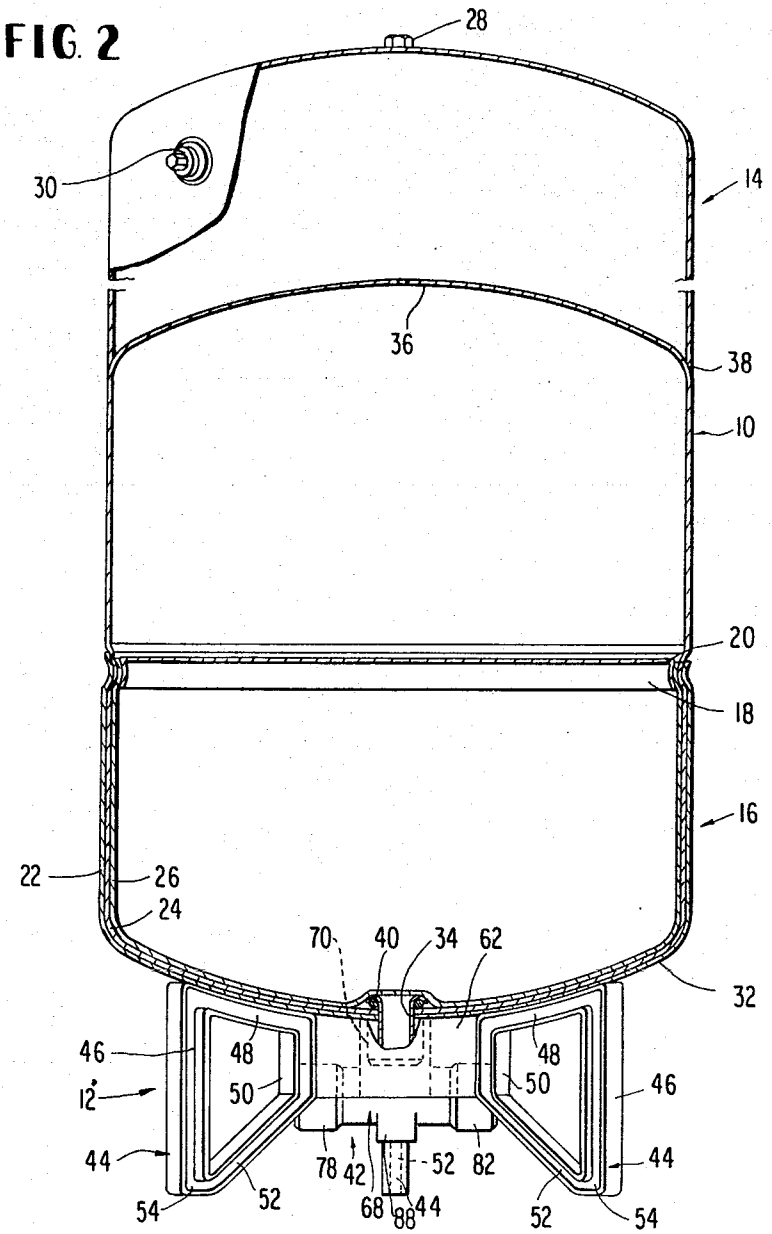
FIG. 2 is a partially cutaway side view of another tank mounted on the tee-type leg bracket of this invention.

Tank 10 shown in FIG. 2 is similar to tank 10 shown in FIG. 1, except that water dome portion 16 extends to dome cover 36 and air dome portion 18 is welded at rim 38.

Bracket 12 of this invention can be used to support any tank which contains a vertical nipple or coupling on the bottom surface thereof (i.e., having a centrally located pipe segment or coupling which is externally threaded on the end). The tank can be constructed of metal (such as, steel, titanium or aluminum), plastic, etc., and can be one or multi-piece. The tank can be lined with glass, epoxy, concrete, rubber, powder coating, galvanized layer, etc., or can have a flexible or non-flexible plastic liner. The tank can be pressurized vessel used as a hot water storage tank, a potable water storage tank, a chlorine holding tank or a solar heat storage tank. The tank can be a pressurized vessel for the storage of potable fluids, such as carbonated beverages, alcoholic beverages, syrups, pharmaceuticals, insecticides, fungicides, pesticides and other chemicals.

Bottom nipple 34 can be constructed of plastic or metal, such as, steel, wrought-iron, cast-iron, brass, copper, aluminum, etc.

Figure 3:
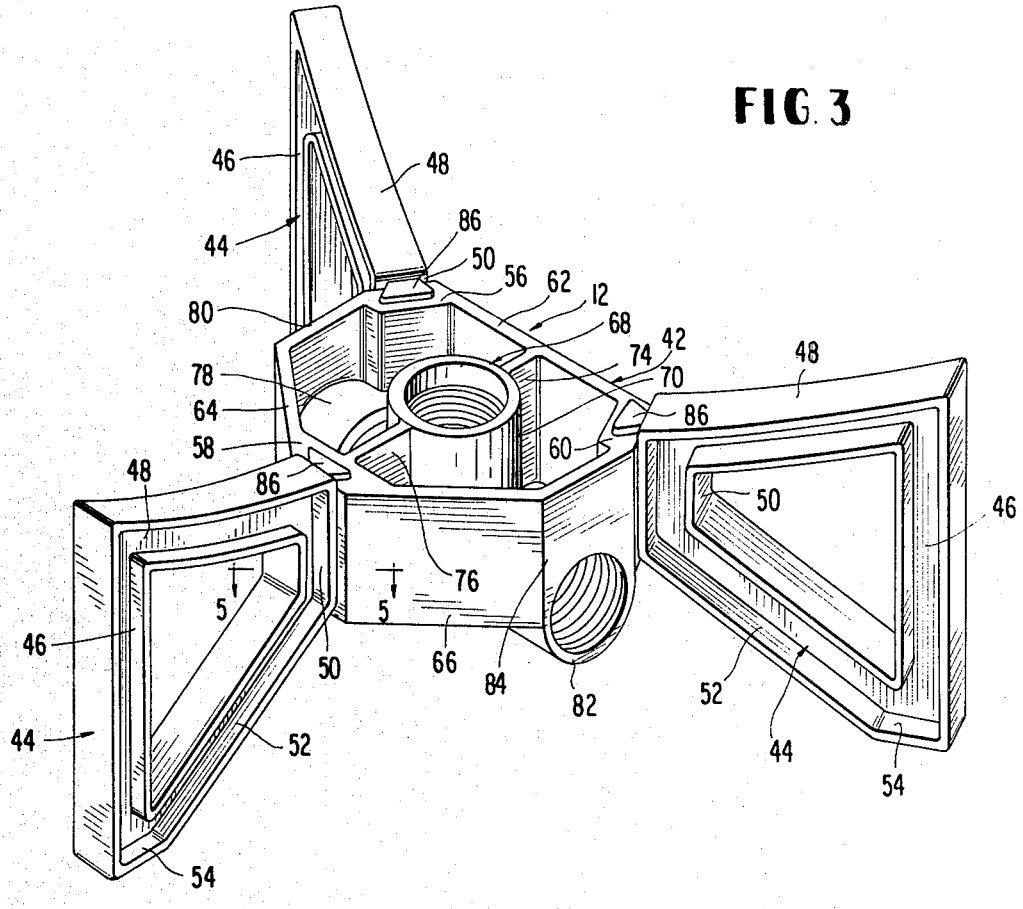
FIG. 3 is a perspective view of the tee-type leg bracket of this invention.

Tee-type leg bracket 12 includes central frame 42 and three support legs 44. Support leg 44, as best seen in FIGS. 3, 6 and 7, is somewhat triangular shaped. Outside segment 46 of support leg 44 is vertical and serves as the support column. Top segment 48 has a top surface contour that corresponds to the contour of bottom surface 32 of tank 10—see FIGS. 1, 2 and 6. Top segment 48 of support leg 44 slopes downward towards its inside end. End side segment 50 of support leg 44 is a short vertical piece and serves as the attachment face to central frame 42. Bottom cross segment 52 of support leg 44 is attached to the lower end of side segment 50 and is attached to the lower end of outside segment 46 so as to form short horizontal piece 54. Horizontal piece 54 acts as the foot support leg 44—see FIG. 6. Segments 46, 48, 50, 52 and 54 all have I-shaped cross-sections.

Figure 4:
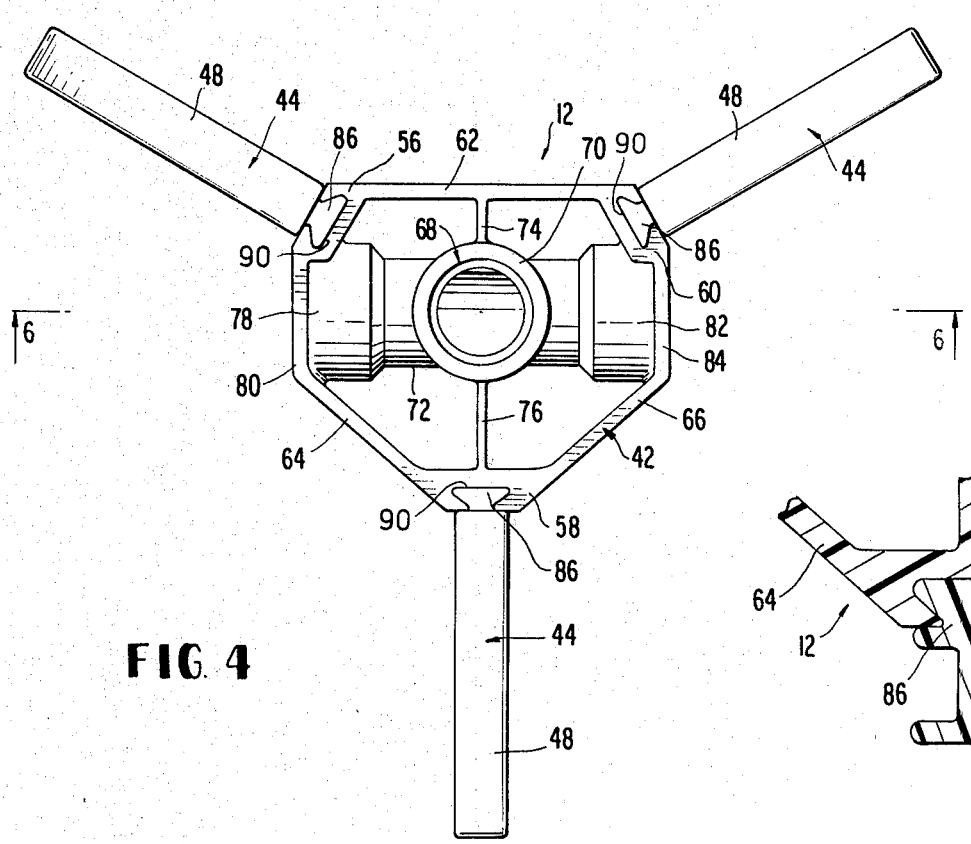
FIG. 4 is a top elevational view of the tee-type leg bracket of this invention.

Central frame 42, as best seen in FIGS. 3, 4 and 7, has three vertical attachment segments 56, 58 and 60. Straight vertical wall segment 62 connects attachment segments 56 and 60. V-shaped vertical wall segment 64 connects attachment segments 56 and 58. V-shaped vertical wall segment 66 connects attachment segments 58 and 60. ⊥-shaped pipe segment 68 (a tee) includes vertical pipe segment 70 and horizontal pipe segment 72. Vertical web 74 is attached to wall segment 62 and vertical pipe segment 70. Vertical web 76 is attached to attachment segment 58 and vertical pipe segment 70. Vertical pipe segment 70 is internally threaded (female threaded) and its top edge is flush with the top edges of wall segments 62, 64 and 66 (which are level on a horizontal plane). See FIG. 6. End pipe segment 78 of tee 68 is mounted in subwall segment 80 of wall segment 64 and its end is flush therewith. End pipe segment 82 of tee 68 is mounted in subwall segment 84 of wall segment 66 and its end is flush therewith. End pipe segments 78 and 82 are internally threaded (female threaded).

Figure 5:
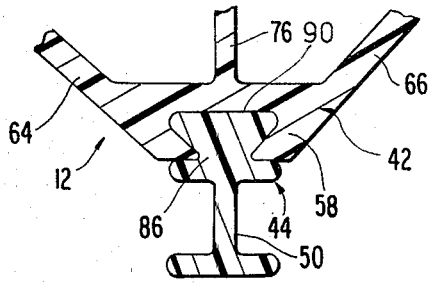
FIG. 5 is a partial cross-sectional view along line 5—5 in FIG. 3 of the attachment joint region of the center frame and one leg of the tee-type leg bracket of this invention.

Vertical attachment segments 56, 58 and 60 of central frame 42 each contain a vertical groove 90. The mouth of vertical groove 90 is narrower in width than the back portion of vertical groove 90—vertical groove 90 has a cross-section which is ▽-shaped. See FIG. 5. Ribs 86 are vertically mounted on side segments 50 of support legs 44. Ribs 86 are wider on their outer edge than on their inner edge—vertical ribs 86 have a cross section which is ⊔-shaped. See FIG. 5. Ribs 86 slidably, but tightly, fit in grooves 90—the clearance is preferably 0.002 inch. The top surface of rib 84 can have the same contour as top segment 48 of support leg 44 or can stop far enough below the top surface of top segment 48 so as not to protrude into the extended contour line of top segment 48.

To assemble, three leg segments 48 are slid onto central frame 42. Vertical pipe segment 70 of tee 68 is threaded onto bottom nipple 34 of tank 10. Block 88 is mounted on the bottom of tee 68 and provides a means to use a pipe wrench or the like to mount or dismount tee-type leg bracket 12 on tank 10. (Instead of a threading system for mounting the tank on the tee-type leg bracket, a flange system can be used. Welding or soldering can be used, but such eliminates some of the advantages of this invention.) With tank 10 in the upright position, leg segments 48 may slightly vertically adjust in alignment (in relation to central frame 42) to fit the contour of bottom surface 32 of tank 10. Pipes (not shown) can easily be attached to horizontal pipe segments 78 and 80 of bracket 12. Or, horizontal pipe segments 78 and 80 can easily be plugged with pipe plugs (not shown) as desired. Tank 10 can easily be removed from bracket 12 without having to disconnect any pipes connected to horizontal pipe segments 78 and 80.

In a typical embodiment, tank 10 has a height of 42½ inches and a diameter of 15⅜ inches, and bracket 12 has a height of 4⅛ inches. Support legs 44 preferably are constructed of 40 percent mineral-filled (talc) polypropylene, color black with U.V. stabilizer, but can be constructed of any plastic having suitable strength, chemical resistance, etc. They can even be constructed of a suitable metal (e.g., steel, aluminum, etc.). Central frame 42 is preferably constructed of glass filled (43 percent) nylon 6/6 with 2 percent carbon black, but can be constructed of any plastic having suitable strength, chemical resistance, non-toxicity, etc. It can even be constructed of a suitable metal (e.g., steel, aluminum, etc.). Support legs 44 are preferably mounted 120 degrees from each other.

If desired a valve can be incorporated in the piping mounted in the tee-type leg bracket of this invention.

What is claimed is:

1. Tee-type leg bracket for supporting a tank, which has a hemispherical-type of bottom surface and a short nipple mounted on the bottom surface at substantially a right angle thereto, comprising (i) a central frame, (ii) a short pipe vertically mounted on the central frame, the vertically-mounted short pipe being adapted to mate with the short nipple mounted on the bottom of the tank, and (iii) at least three support legs detachably attached to the central frame, the bottom surface of the tank resting on the top portion of the support legs.

2. The tee-type leg bracket as claimed in claim 1 wherein there are three support legs.

3. The tee-type leg bracket as claimed in claim 1 wherein the contour of the top surface of the support legs matches the contour of the bottom surface of the tank.

4. The tee-type leg bracket as claimed in claim 1 wherein means of attaching the support legs to the central frame comprises vertical grooves in the edge region of the central frame, the mouth of each of the vertical grooves being narrower than the interior portion thereof, the number of vertical grooves being equal in number to the support legs, and a vertical rib on one end of each of the support legs, each of the vertical ribs having the same horizontal cross-section as the horizontal cross-section of each of the vertical grooves in the central frame and slidably fitting into one of the vertical grooves.

5. The tee-type leg bracket as claimed in claim 1 wherein the short pipe is centrally located on the central frame of the bracket.

6. The tee-type leg bracket as claimed in claim 5 wherein the short nipple mounted on the bottom of the tank is externally threaded on the end portion thereof, and the centrally-located short pipe mounted on the central frame of the bracket is internally threaded on the end portion and is adapted to threadingly mate and communicate with the short nipple mounted on the bottom of the tank.

7. The tee-type leg bracket as claimed in claim 1 wherein at least one short pipe communicates with the vertically-mounted short pipe on the central frame of the bracket and is horizontally mounted on the central frame of the bracket.

8. The tee-type bracket as claimed in claim 1 wherein the vertically-mounted short pipe is the upper arm of a tee.

9. The tee-type leg bracket as claimed in claim 8 wherein the ends of the horizontal arm of the tee are mounted on and extend through two opposing walls of the central frame of the bracket.

10. The combination of a tank, which has a hemispherical-type of bottom surface and a short nipple mounted on the bottom surface at substantially a right angle thereto, mounted on a tee-type leg bracket comprised of (i) a central frame, (ii) a short pipe vertically mounted on the central frame, the vertically-mounted short pipe being adapted to mate with the short nipple mounted on the bottom of the tank, and (iii) at least three support legs detachably attached to the central frame, the bottom surface of the tank resting on the top portion of the support legs.

11. The combination as claimed in claim 10 wherein the tee-type leg bracket has three support legs.

12. The combination as claimed in claim 10 wherein the contour of the top surface of the support legs of the tee-type leg bracket matches the contour of the bottom surface of the tank.

13. The combination as claimed in claim 10 wherein means of attaching the support legs to the central frame comprises vertical grooves in the edge region of the central frame, the mouth of each of the vertical grooves being narrower than the interior portion thereof, the number of vertical grooves being equal in number to the support legs, and a vertical rib on one end of each of the support legs, each of the vertical ribs having the same horizontal cross-section as the horizontal cross-section of each of the vertical grooves in the central frame and slidably fitting into one of the vertical grooves.

14. The combination as claimed in claim 10 wherein the short pipe is centrally located on the central frame of the bracket.

15. The combination as claimed in claim 14 wherein the short nipple mounted on the bottom of the tank is externally threaded on the end portion thereof, and the centrally-located short pipe mounted on the central frame of the bracket is internally threaded on the end portion and is adapted to threadingly mate and communicate with the short nipple mounted on the bottom of the tank.

16. The combination as claimed in claim 10 wherein at least one short pipe communicates with the vertically-mounted short pipe on the central frame of the bracket and is horizontally mounted on the central frame of the bracket.

17. The tee-type leg bracket as claimed in claim 10 wherein the vertically-mounted short arm is the upper arm of a tee.

18. The combination as claimed in claim 17 wherein the ends of horizontal arm of the tee are mounted on and extend through two opposing walls of the central frame of the bracket.

19. A unitized package combination of a tank, which has a hemispherical-type of bottom surface and a short nipple mounted on the bottom surface at substantially a right angle thereto, a central frame of a tee-type leg bracket with a short pipe vertically mounted on the central frame, the vertically-mounted short pipe being adapted to mate with the short nipple mounted on the bottom of the tank, and at least three support legs of the tee-type leg brackets, the support legs being detachably attachable to the central frame.

* * * * *